US006363669B1

(12) United States Patent
Hoffman

(10) Patent No.: US 6,363,669 B1
(45) Date of Patent: Apr. 2, 2002

(54) PENETRATION RESISTANT STORM WINDOW

(76) Inventor: Robert E. Hoffman, 5618 Riviera Dr., Coral Gables, FL (US) 33146

( * ) Notice: Subject to any disclaimer, the term of this patent is extended or adjusted under 35 U.S.C. 154(b) by 0 days.

(21) Appl. No.: 09/425,435

(22) Filed: Oct. 22, 1999

(51) Int. Cl.[7] ..... E06B 3/26
(52) U.S. Cl. ..... 52/202
(58) Field of Search ..... 52/308, 202; 109/49.5

(56) References Cited

U.S. PATENT DOCUMENTS 4,630,411 A * 12/1986 Salzer ..... 52/202

FOREIGN PATENT DOCUMENTS

CA 467982 * 9/1950 ..... 52/202
FR 2291337 * 7/1976 ..... 52/202
FR 2312637 * 1/1977 ..... 52/202

* cited by examiner

*Primary Examiner*—Peter M. Cuomo
*Assistant Examiner*—Jerry A. Anderson

(57) ABSTRACT

A framed storm window construction having a relatively thick, impact and penetration resistant panel surrounded by a frame for mounting either over or within an opening formed in a wall. The peripheral edges of the panel fit within interior channels formed in the frame members. The frame members each have exterior channels on its exterior peripheral edges which define outwardly opening channels. Connector members having tongue portions fitted and held within said channels extend outwardly of the channels and terminate in connector strip flanges which are adapted to be secured, by mechanical fasteners, to the edge portions defining a window opening in a building wall. The framed window resists penetration by forcefully applied objects, such as wind hurled debris.

18 Claims, 2 Drawing Sheets

FIG - 1
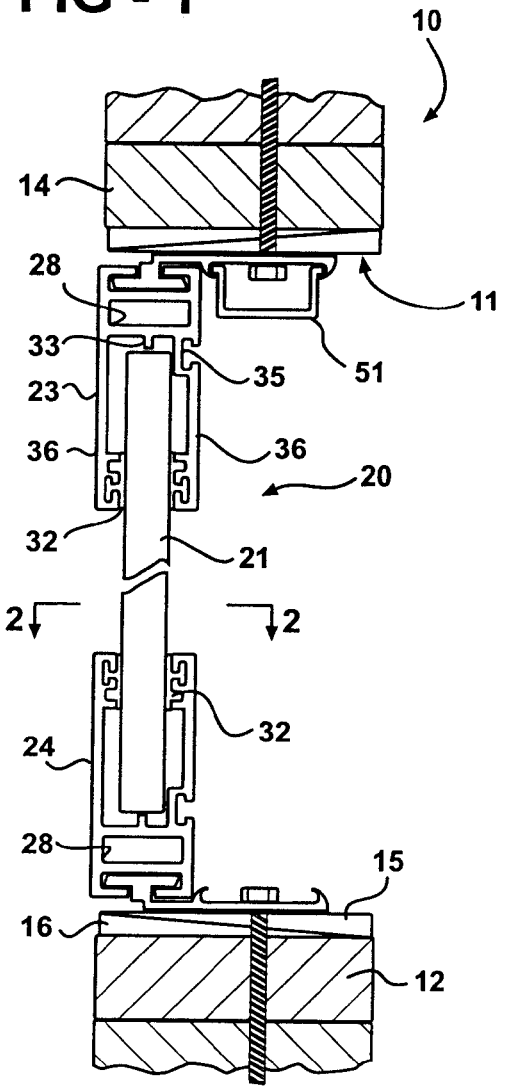
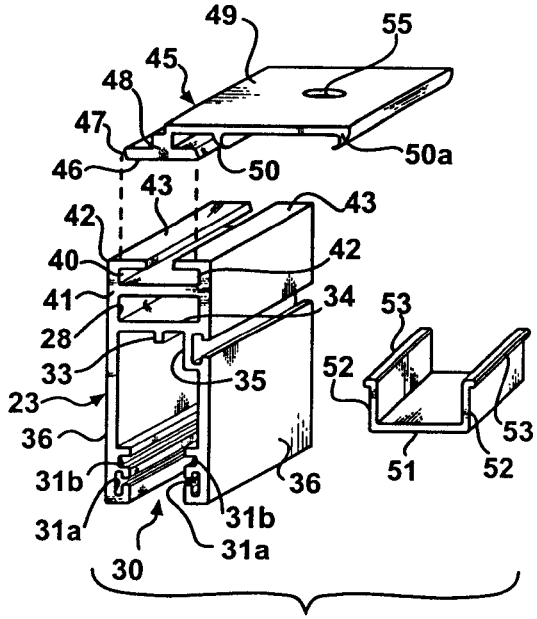
FIG - 3
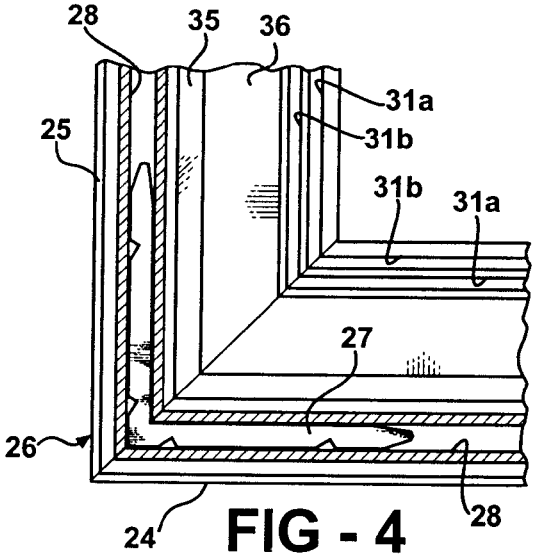
FIG - 4
FIG - 2
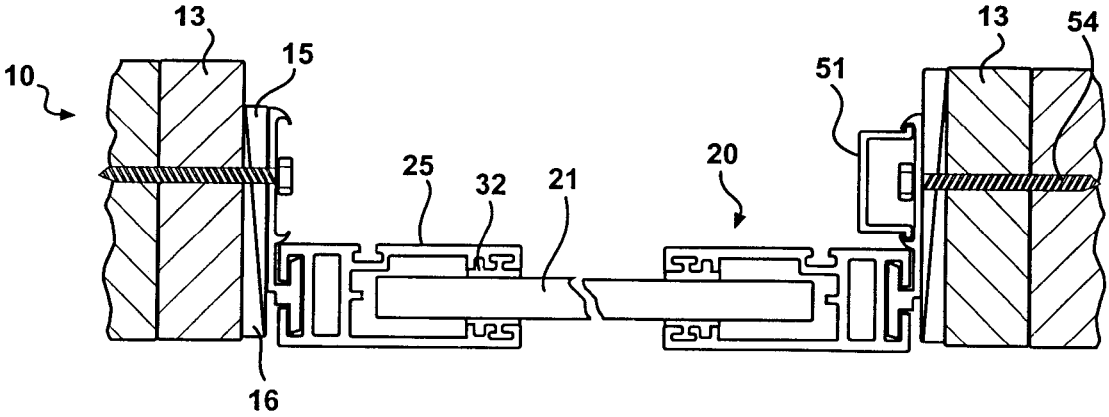

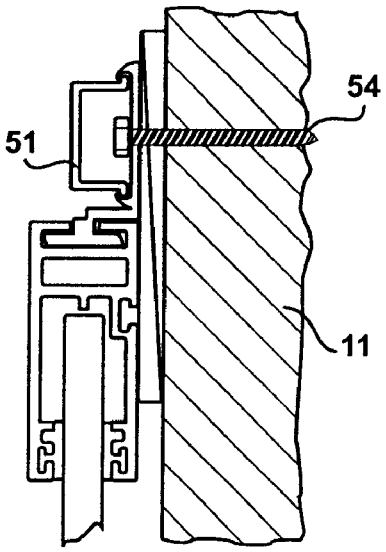
FIG - 5
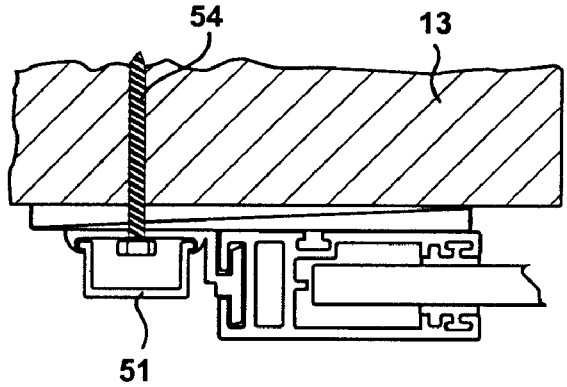
FIG - 6
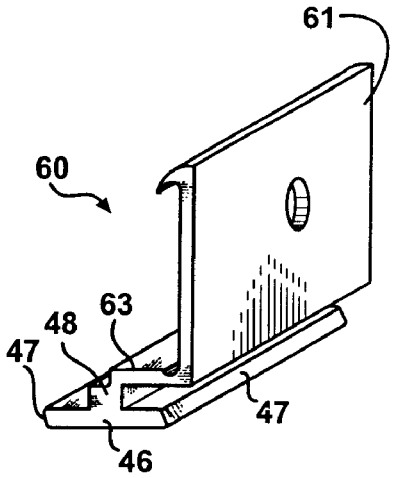
FIG - 7
FIG - 8
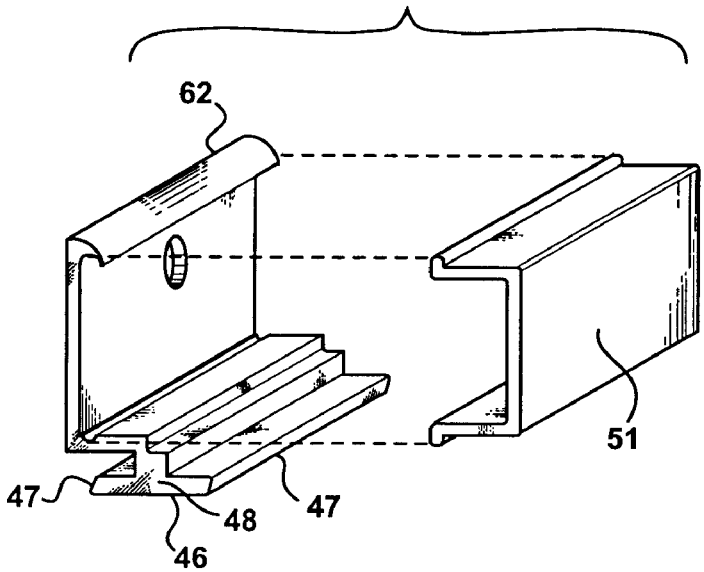

PENETRATION RESISTANT STORM WINDOW

BACKGROUND OF INVENTION

This invention relates to a penetration resistant storm window which will resist impacts of wind hurled debris resulting from hurricane force winds and the like.

In many areas of the country, solid debris thrown by strong winds, such as hurricane or tornado force winds, penetrate windows and window openings in buildings, causing considerable damage to the interiors of such buildings in addition to breaking the windows. Storm windows and storm shutters and panels are commonly used in areas that are particularly susceptible to such high force winds. However, in many applications, shutters or storm panels, particularly those which are opaque, are either not practical or cannot be installed in time before a storm. Therefore, it would be desirable to have a storm panel system, in the form of a transparent window unit, which can be applied over a conventional window or window opening and can remain in place for long periods of time. Alternatively, it would be desirable to have a similar type of structure which can be easily and quickly applied and can be easily and quickly removed when desired. Thus, such a storm panel either may be applied well in advance of a particular storm, as for example during a storm season, because the panel will be sufficiently transparent to function as a window, or the panel may be mounted just before the arrival of a particular storm.

Hence, this invention is concerned with providing a strong window structure which can resist penetration by foreign objects hurled by high winds and, also, can pass current storm debris penetration tests that are now required for buildings in some areas of the country. For example, one current debris penetration resistant test involves hurling a 2×4 inch wooden piece at approximately 34 miles per hour at a storm panel or shutter or other window structure in a building. Penetration of the panel or shutter by the hurled member fails the test. That is, to pass the test, the storm covering panel or shutter or structure must be capable of resisting penetration at that level of force.

The invention herein involves an improved storm window assembly having a strong, transparent plastic panel surrounded by an extruded metal window frame which is mountable either within or upon an opening in a building wall and is so designed that it will prevent penetration by foreign objects at predetermined levels of force.

SUMMARY OF INVENTION

This invention relates to a framed window assembly comprising a relatively thick, strong, plastic-type, panel which is preferably transparent and is mounted within an extruded metal frame. The frame may be fastened either within the boundaries of an opening in a building wall or it may be fastened upon the exterior surface of the edges defining a wall opening. Thus, the frame is fastened in place by a connector or mounting member having a continuous tongue portion which is snugly fitted and frictionally retained within a channel formed on the exterior periphery of the frame. The connector has a portion which extends outwardly of the channel and forms a substantially continuous connector strip for overlapping the interior or exterior edges which define the window opening. That is, the strip may be formed to fit within the window opening or to fit over the exterior surfaces of the window opening. Mechanical fasteners, such as screws or the like, secure the connector strip to the peripheral edges of the opening.

The mounting or connector member is so formed that the framed storm window unit may be easily and quickly installed, without special tools by an unskilled person, either within or over a window opening when needed and may be left in place for long periods of time, such as during a hurricane season, because the unit will not substantially obscure visibility through the window nor the ingress of light through the window. Conversely, the unit may be easily removed for window cleaning or for storage when desired.

One object of this invention is to provide a strong, durable, relatively inexpensive and easily mountable storm window construction which will pass current anti-penetration tests used in a number of areas in the country for storm debris protection.

Another object of this invention is to provide an inexpensive, relatively attractive storm window which may be easily applied in advance of need and left in place for long periods of time or, alternatively, may be easily and quickly applied and removed when actually needed for storm protection.

Still another object of this invention is to provide a mounting system for securing a storm window in place over or within a window opening in a wall with minimal labor and with ordinary tools for, thereby, simplifying installation and removal of the storm window.

Yet another object of this invention is to provide a framed storm window having a mounting arrangement which serves to reinforce the window frame structure as well as to provide the means for mounting the framed window upon or within the wall structure defining a window opening in a building.

These and other objects and advantages will become apparent upon reading the following description, of which the attached drawings form a part.

DESCRIPTION OF DRAWINGS

FIG. 1 is a schematic, elevational, cross-sectional view of the storm window mounted within a window opening in a building wall.

FIG. 2 is a schematic, partially cross-section, view taken in the direction of arrows 2–2 of FIG. 1.

FIG. 3 is an enlarged, perspective view of a disassembled frame, and the mounting or connecting member and cover parts of the window unit.

FIG. 4 is an enlarged, cross-sectional view of the frame corner construction, showing adjacent ends of two of the window frame forming members connected together.

FIG. 5 is a schematic, cross-sectional view of the upper portion of a framed storm window mounted by a modified connecting member on the exterior surface of the wall portion surrounding a window opening.

FIG. 6 is a cross-sectional, fragmentary view of a side portion of the window frame of FIG. 5 secured to the exterior surface of the wall defining the window opening.

FIG. 7 is a fragmentary, perspective view of a portion of the connector member used in mounting the window frame as shown in FIGS. 5 and 6, and FIG. 8 is a perspective, fragmentary view, similar to FIG. 7 but showing the opposite surface of the connector member and, also, illustrating a portion of a cover channel used with the connector member.

DETAILED DESCRIPTION

FIGS. 1 and 2 schematically illustrate a building wall 10 having a window opening 11 formed therein. The opening is defined by a lower sill member 12, side jambs 13 and an upper header 14. The building wall and the opening constructions may vary considerably. Thus, the particular structure shown is for illustrative purposes only.

In order to accurately dimension the interior peripheral boundary of the opening, overlapped, conventional shims 15 and 16, which are wedge shaped, may be utilized. These shims are shown for illustrative purposes, since they would not be necessary where the dimensions of the window opening are accurately made initially.

Typically, the window opening would already have a conventional window closure which could be, for example, a double-hung window structure or a louvered window structure or a sliding or swinging window panel structure. In some cases, the opening may be unobstructed without any window, such as in tropical areas. In any event, the conventional window, if used, is omitted from the drawings for illustration purposes. The purpose of the present storm window structure is to overlie the window opening to protect the existing window or, the otherwise unobstructed window opening, against penetration by forcefully thrown foreign objects, such as storm debris. The storm window unit, generally designated 20, comprises a framed, penetration resistant window panel 21. The panel 21 is preferably formed of a thick, transparent or substantially transparent, heavy plastic material, such as a commercially available polycarbonate plastic material. While the panel material may vary considerably, depending upon commercial availability and strength required, one example is a ⅜ inch monolithic polycarbonate sheet material which is commercially available. Other, thick plastic sheet materials may be used.

The panel 21 is mounted within a frame 22 which is preferably formed of extruded aluminum. The frame comprises an upper frame member 23, a lower frame member 24, and side frame members 25 which are connected together at their adjacent ends. FIG. 4 illustrates a typical corner 26 which is formed by the 45 degree cut, adjacent ends of two frame members 24 and 25, held together by a conventional corner key 27 mounted within key channels 28 formed in the extruded frame members.

Preferably, the frame members are all of the same profile or cross-section. This simplifies and reduces the expense of the frame construction. The frame members are provided with an inner channel 30 (see FIG. 3) which receives the peripheral edges of the panel 21. In addition, the frame members have pairs of opposed side channels 31*a* and 31*b* formed within the walls of the inner channel 30. These side channels receive and hold conventional, resilient glazing strips 32 in position for sealing against the peripheral edges of the panel 21. This is a conventional construction used in mounting panels within extruded aluminum frames and the specific details thereof can be varied depending on commercial availability, cost, required strength and the like.

A continuous end bumper bead 33 is integrally formed on the base 34 of the inner channel 30 (see FIG. 3). Also, side bumper channels 36 are formed on one of the side walls 36 of the inner channel 30. These bumper beads assist in positioning the panel 21 within the channels 30 and, in addition, rigidify or stiffen the frame members and tend to back up the peripheral edges of the panel 21 in the event of movement of the panel within the frame. Such movement could occur during high wind conditions or during impacts of objects against the panel. Hence, these bumper beads and channels act both as positioning devices and as reinforcement columns when needed.

The frame members are provided with continuous outer channels 40. These outer channels are formed by a base 41, side walls 42, which are extensions of the side walls 36 of the frame members, and opposed flanges 43. The free edges of the flanges 43 are spaced apart to provide a gap therebetween. Thus, the outer channels 40 are generally square, C-shape in cross-section (see FIG. 3). Preferably, the outer channels are of considerably greater width, that is, in the direction transverse of the window panel, than height.

The framed storm panel is secured in place within the window opening by means of connector or mounting members 45. These members are preferably formed of extruded aluminum which are cut to length to coincide with the lengths of their respective frame members. The connector members are secured to the frame members by integral tongues 46, having curved ends 47. These tongues slidably fit within the outer channels 40 and are frictionally held therein. Preferably, the tongues are in the form of flat, narrow strips arranged in planes that are transverse to the window panel. Hence, they reinforce the frame members against bending under impacts.

The tongues have integral central flanges or beads 48 which extend outwardly through the space between the free ends of the flanges 43 and are integral with a widened connector flange 49. One surface of the connector flange 49 is adapted to be placed against, that is, overlapping, the adjacent wall structure (e.g. the shims 15 and 16) defining the window opening. The opposite, exposed face of the connection flange 49 is provided with a spaced apart pair of integral, hook like edge beads 50 and 50*a*. Channel shaped cover extrusions 51, whose side legs 52 are provided with beads or widened end portions 53, are placed against the respective connector flanges 49 and fit between and are frictionally held in place by, the hook-like beads 50 and 50*a* formed on the connector flange.

The connector strips are mechanically secured to the building structure or edge portions which define the window opening. For example, screws 54 may be inserted through holes 55 formed in the connector strips 49. Thus, the cover channels 51 cover, as well as reinforce, the interior, exposed surfaces of the connector strip.

FIGS. 5–8, inclusive, illustrate a modified connector or mounting member 10 for mounting the storm window unit over the exterior or exposed surface of the wall rather than within the opening in the wall as shown by the modification of FIGS. 1–4. FIGS. 5 and 6 illustrate portions of a framed storm window which is the same as that described above in connection with the modification of FIGS. 1–4. However, the connector member 60 is formed with its connector strip or flange 61 extending outwardly, that is, generally parallel to, the plane of the panel. Therefore, the strip 61 is integrally joined with an offset edge portion 63 of the part 48 of the connector and extends approximately perpendicular to the tongue portions 46 of the connector member (see FIGS. 7 and 8). Hence, the connector flanges or strips 61 overlap the outer wall surface portions which define the window opening.

FIGS. 7 and 8 are fragmentary views, illustrating the modified connector member 60 which show the approximately perpendicular relationship between the tongue 46 and connector strip 61 portions. FIG. 8 also illustrates the cover channel 51 which, in this case, will be engaged between an outer edge bead 62 and the inner step-like, or offset, bent portion 63 of the connector member.

As can be seen, the storm window assembly may be mounted within a window opening or upon the exterior surfaces of the building wall portions which define a window opening by using the appropriate connector member. Installation is easily performed with ordinary hand tools, such as a screwdriver, for placing screws through the connector members into the wall structure for holding the window in place. When the storm windows are inserted within the window opening, a person standing within the building may easily mount the storm windows with minimal mechanical skill. Thus, a typical homeowner or handyman can easily mount the units in place when desired.

The thick panel, coupled with the arrangement of the extruded frame members and the separate, but interlocked connector member, together form a rigid, strong structure which can absorb and resist considerable impact forces without breaking. Nevertheless, the arrangement between the connection member and the exterior channel of the frame members, provides some small amount of resiliency and relative movement of the parts when subjected to a high impact load. This tends to absorb and resist the destructive effect of such impacts.

The cross-sectional shape or profile of the frame members may be varied somewhat, provided that each frame member is still provided with an interior channel to receive the peripheral edges of the panel and an exterior channel shaped to receive and interlock with the connector member that fastens it to the building wall portions. The sizes and precise shapes of the elements may be varied somewhat by one skilled in the art considering the ultimate strength and impact resistance to be pre-designed into the system.

This invention may be further developed within the scope of the following claims.

Having fully described an operative embodiment of this invention, I now claim:

1. A penetration resistant window assembly for covering a building wall window opening defined by header, opposed jambs and sill edge portions, comprising:

a window frame having opposite side, top and bottom elongated frame members joined together at adjacent ends and with continuous inner and outer channels formed in, and extending along the lengths of, each frame member;

a window panel, formed of an impact resistant material, arranged within the frame and having outer peripheral edges fitted within the inner channels of the frame members to form a framed window unit;

each of said frame member outer channels opening toward respective adjacent window opening edge portions;

elongated connector strips for securing the frame members to the window edge portions, said elongated connector strips having a length and are positioned with respect to one another to surround the window opening, with each strip having a tongue snugly fitted within the outer channel of a respective member and a strip flange integrally joined to said tongue, with the strip flanges extending along the respective frame members and arranged to overlap adjacent window opening edge portions;

and mechanical fasteners securing each of the strip flanges to adjacent window opening edge portions;

whereby the window assembly resists penetration by forcefully applied foreign objects, such as wind hurled debris, impacted against the window panel.

2. A penetration resistant window assembly as defined in claim 1 and including:

the outer channel in each frame member comprising a base wall arranged transversely of the frame member, a pair of spaced apart side walls which are arranged normal to the base wall and terminating in a pair of frame member flanges extending towards each other, generally parallel to the base wall, and with a narrow space formed between the free edges of the frame member flanges;

and said tongues being formed of a generally flat strip having a cross-sectional size and shape to fit closely within the space provided between the base and side walls and flanges, and with an integral bead extending through the narrow space between the free edges of the frame flanges and integrally connecting the tongue to the strip flange.

3. A penetration resistant window assembly as defined in claim 2, and said strip flanges being substantially parallel to said tongues for fitting within the window opening and overlapping the interior surfaces of the window opening edge portions, that is, the surfaces of the edge portions which are arranged within the window opening, when the window frame is positioned within the opening.

4. A penetration resistant window assembly as defined in claim 2, and including said strip flanges being substantially perpendicular to said tongues for overlapping the exterior portions of the wall defining the window opening edge portions so that the strip flanges are located on the exterior surface of the wall portions surrounding and defining the window opening.

5. A penetration resistant window assembly as defined in claim 2, and including a shallow channel formed on the exposed surface of the strip flange, that is, the surface of the strip flange which is opposite to the surface thereof that is arranged against the wall edge portions;

and a cover in the form of a continuous channel positioned over and engaging within the strip flange channel and opening towards the strip for covering the mechanical fasteners securing the strip flanges to the window opening edge portions.

6. A construction as defined in claim 5, and with said shallow channels being formed by a pair of spaced apart, parallel beads formed integral with and extending along the length of the strip flanges, and with the cover channel having channel legs which fit between and engage the beads for frictionally securing the cover to the strip flange.

7. A construction as defined in claim 2 and with said window panel being formed of a thick, impact resistant, transparent plastic sheet material.

8. A penetration resistant storm window formed of a relatively thick, impact resistant window panel with a window frame surrounding the exterior edges of the panel for mounting the panel upon a wall for covering a window opening formed in the wall, and with the wall opening having upper, lower and side edge portions defining said opening therein, comprising:

elongated, substantially uniform cross-section frame members joined together at ends to form said frame, and the frame members having inner channels extending along the frame members for receiving the peripheral edges of the window panel;

the frame members having exterior channels, and each exterior channel being formed of a transverse, wide, base wall and narrow side walls arranged normal to the base wall and outer flanges extending from the side walls towards each other, with a space arranged between the free edges of the flanges so that the exterior channel in each member is generally of a flattened, squared, C-shape in cross-section;

connector members for connecting the frame members to their adjacent window opening edge portions, said elongated connector strips having a length and are positioned with respect to one another to surround the window opening; each connector member comprising an elongated tongue strip closely fitted within a frame member exterior channel and an outwardly extending bead integrally formed on the tongue strip and closely fitted within and extending through the space between said outer flanges;

a connector member flange formed integral with said bead and extending along the connector member for fastening the connector member and, therefore, the frame members, to the adjacent window opening edge portions;

whereby the framed window will cover the window opening in the wall and will resist penetration by forcefully applied objects, such as wind hurled debris, impacted against the window panel.

9. A window construction as defined in claim 8, and each of said connector member flanges being substantially parallel to the tongue to which it is connected for overlapping the interior surfaces of the window opening edge portions defining the window opening in the wall so that the window is adapted to be mounted within, and surrounded by, the wall edges defining the window opening.

10. A window construction as defined in claim 8 and including said connector member flanges being arranged substantially perpendicular to the tongue to which each is secured for overlapping the exterior wall surfaces of the edges defining the wall window opening so that the framed window is positioned upon the exterior surface of the wall for covering the wall opening.

11. A window construction as defined in claim 8, and including a raised bead-like formation formed integral on exposed surfaces on each of the connector member flanges and spaced from the bead which joins the tongue and strip connector flange together to provide a shallow channel on the exposed surfaces of each of the connector member flanges;

and a cover in the form of a continuous channel positioned over and engaged within said shallow channel and opening towards respective connector member flange for covering mechanical fasteners that may be used for mechanically securing the connector strips to the window opening edges.

12. A window construction as defined in claim 8, and including a shallow channel formed on exposed surfaces of the connector member flanges, that is, the surfaces opposite to the surface thereof arranged against the wall edge portions, with said shallow channels being formed by a pair of spaced apart, parallel beads formed integral with the connector member flange;

and a cover, in the form of a channel, having channel legs which are fitted between and engage the beads for securing the cover to the channel strip flange and thereby covering any mechanical fasteners utilized to secure the connector strip flanges to the window edge portions which they overlap.

13. A construction as defined in claim 8, and including said window panel being formed of a thick, impact resistant, transparent sheet material.

14. A window frame for a penetration resistant window comprising:

frame members joined together at their adjacent ends and having aligned interior channels for receiving the edges of a thick, impact resistant panel, comprising:

the frame members having exterior channels for receiving connector members for fastening the frame members to their window opening edge portions which define a window opening formed in a wall;

said connector members each having a tongue portion, an integral bead portion and an exterior connector strip flange portion, said elongated connector strips having a length and are positioned with respect to one another to surround the window opening, with the tongue portion snugly fitted within and frictionally retained within a frame member exterior channel with the connector member bead portion extending outwardly through an open mouth of the frame member exterior channel and the connector strip portion arranged to overlap and be mechanically secured to the edge portions which define an opening in a window wall;

whereby the frame with the panel, when assembled and secured over a window opening, will resist penetration by forcefully applied objects, such as wind hurled debris, impacted against the window panel.

15. A window frame construction as defined in claim 14, and with the connector member strip flange being arranged parallel to the connector member tongue and arranged to engage and overlap the adjacent edge portions defining the window opening for securement against the interior surfaces of the edge portions which define the opening.

16. A frame construction as defined in claim 14, and including said frame being adapted to be mounted upon the exterior surface of the portion of the wall defining the wall opening, and with its connector member flange being formed substantially normal to its respective tongue portion for overlapping the exterior surface of the wall edge portions which define the wall opening.

17. A window frame construction as defined in claim 14, and including a shallow channel formed on each exposed surfaces of the connector member strip flanges, that is upon the surfaces of the connector member strip flanges that are opposite to surfaces thereof which are arranged against wall edge portions;

and a cover in the form of an elongated channel arranged to overlap the flange channel and to fit within the flange channel for covering mechanical fasteners utilized for securing the flanges to the adjacent edge portions defining the opening in a wall.

18. A window frame construction as defined in claim 14, and said tongue portions being formed of elongated, flat, narrow strips arranged in planes that are perpendicular to the plane of the window panel and with the exterior channels being of corresponding cross-sectional shape, so that the tongue portions reinforce the frame members within which they are positioned.

* * * * *